US008718533B2

(12) United States Patent
Yoon

(10) Patent No.: US 8,718,533 B2
(45) Date of Patent: May 6, 2014

(54) IMAGE FORMING APPARATUS

(75) Inventor: Hyung Won Yoon, Seongnam-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 269 days.

(21) Appl. No.: 12/923,121

(22) Filed: Sep. 2, 2010

(65) Prior Publication Data

US 2011/0089795 A1 Apr. 21, 2011

(30) Foreign Application Priority Data

Oct. 15, 2009 (KR) ..... 10-2009-97976

(51) Int. Cl.
*G03G 15/00* (2006.01)
*B41J 29/02* (2006.01)

(52) U.S. Cl.
USPC ..... 399/401; 399/392; 400/693

(58) Field of Classification Search
USPC ..... 399/392, 401, 364; 400/693
See application file for complete search history.

(56) References Cited

U.S. PATENT DOCUMENTS

| | | | | |
|---|---|---|---|---|
| 6,219,507 | B1 * | 4/2001 | Yoneda et al. | 399/110 |
| 6,892,046 | B2 * | 5/2005 | Fujita et al. | 399/381 |
| 7,062,216 | B2 * | 6/2006 | Nobe et al. | 399/391 |
| 7,587,166 | B2 * | 9/2009 | Aono | 399/401 |
| 2002/0114634 | A1 * | 8/2002 | Ahn et al. | 399/13 |

FOREIGN PATENT DOCUMENTS

JP 2001012562 A * 1/2001

* cited by examiner

*Primary Examiner* — Matthew G Marini
*Assistant Examiner* — John M Royston
(74) *Attorney, Agent, or Firm* — Staas & Halsey LLP

(57) ABSTRACT

The image forming apparatus includes a cover member attached to and detached from a main body in a sliding manner, and achieves power transmission from the main body to driving elements of the cover member through an electronic clutch, thereby simplifying a power transmission structure and improving reliability.

8 Claims, 6 Drawing Sheets

IMAGE FORMING APPARATUS

CROSS-REFERENCE TO RELATED APPLICATIONS

This application claims the benefit of Korean Patent Application No. 2009-0097976, filed on Oct. 15, 2009 in the Korean Intellectual Property Office, the disclosure of which is incorporated herein by reference.

BACKGROUND

1. Field

Embodiments relate to an image forming apparatus having a structure to transmit power to a cover member opened and closed in a sliding manner.

2. Description of the Related Art

In general, image forming apparatuses are apparatuses which form an image on print media according to an input image signal, and correspond to printers, photocopiers, facsimile machines, and multi-functional having combined functions thereof.

An image forming apparatus includes a main body and a cover member which is attached to and detached from the main body in a sliding manner in order to increase assembly and service performances and to easily remove a paper jam.

Driving elements to transfer printing media, such as a duplex printing unit or a paper feeding tray, may be provided on the cover member. These driving elements perform operations to achieve respective functions according to power transmitted from the main body.

Therefore, if the cover member is connected to the main body, a power transmission structure to transmit power from an engine of the main body to the driving elements provided on the cover member is required.

SUMMARY

Therefore, it is one aspect to provide an image forming apparatus which simplifies a structure to transmit power from a main body to driving elements of a cover member.

It is a further aspect to provide an image forming apparatus which reduces noise generated when a cover member is mounted on a main body.

It is another aspect to provide an image forming apparatus which reduces power transmission loss when power is transmitted from a main body to driving elements of a cover member.

Additional aspects will be set forth in part in the description which follows and, in part, will be apparent from the description, or may be learned by practice of the invention.

In accordance with one aspect, an image forming apparatus includes a main body provided with an opening, a cover member slidably provided on the main body so as to open and close the opening, and provided with roller members driven by power transmitted from a driving gear provided on the main body, and an electronic clutch transmitting driving force to the roller members, and provided with a gear part engaged with the driving gear when the cover member is mounted on the main body so as to close the opening.

When the gear part and the driving gear are engaged with each other, a direction of a tangent line passing a pitch point between the gear part and the driving gear may coincide with a progress direction of the cover member.

When the gear part and the driving gear are engaged with each other, a line obtained by connecting a center of the gear part and a center of the driving gear may be perpendicular to a progress direction of the cover member.

The gear part may approach in a direction in which a line obtained by connecting a center of the gear part and a center of the driving gear is perpendicular to a progress direction of the cover member.

The roller members may include return rollers of a duplex printing unit.

The roller members may include a manual paper feeding pick-up roller to pick up printing media loaded on a manual paper feeding tray.

The image forming apparatus may further include guide rails to guide sliding of the cover member into and out of the main body.

Hook parts connected to the main body may be provided on the cover member.

The electronic clutch may be coaxial with the roller members.

In accordance with a further aspect, an image forming apparatus includes a main body provided with a driving gear, a cover member provided with roller members rotated by power transmitted from the driving gear, and slidably attached to and detached from the main body, and an electronic clutch provided with a gear part engaged with the driving gear so as to transmit rotary force of the driving gear to the roller members when the cover member is mounted on the main body.

An electrical signal may not be applied to the electronic clutch when the cover member is attached to and detached from the main body.

When the gear part and the driving gear are engaged with each other, a direction of a tangent line passing a pitch point between the gear part and the driving gear may coincide with a progress direction of the cover member.

When the gear part and the driving gear are engaged with each other, a line obtained by connecting a center of the gear part and a center of the driving gear may be perpendicular to a progress direction of the cover member.

The electronic clutch may be interlocked with the roller members.

The electronic clutch may be coaxial with the roller members.

The roller members may include return rollers of a duplex printing unit.

The roller members may include a manual paper feeding pick-up roller to pick up printing media loaded on a manual paper feeding tray.

The gear part may approach in a direction in which a line obtained by connecting a center of the gear part and a center of the driving gear is perpendicular to a progress direction of the cover member.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
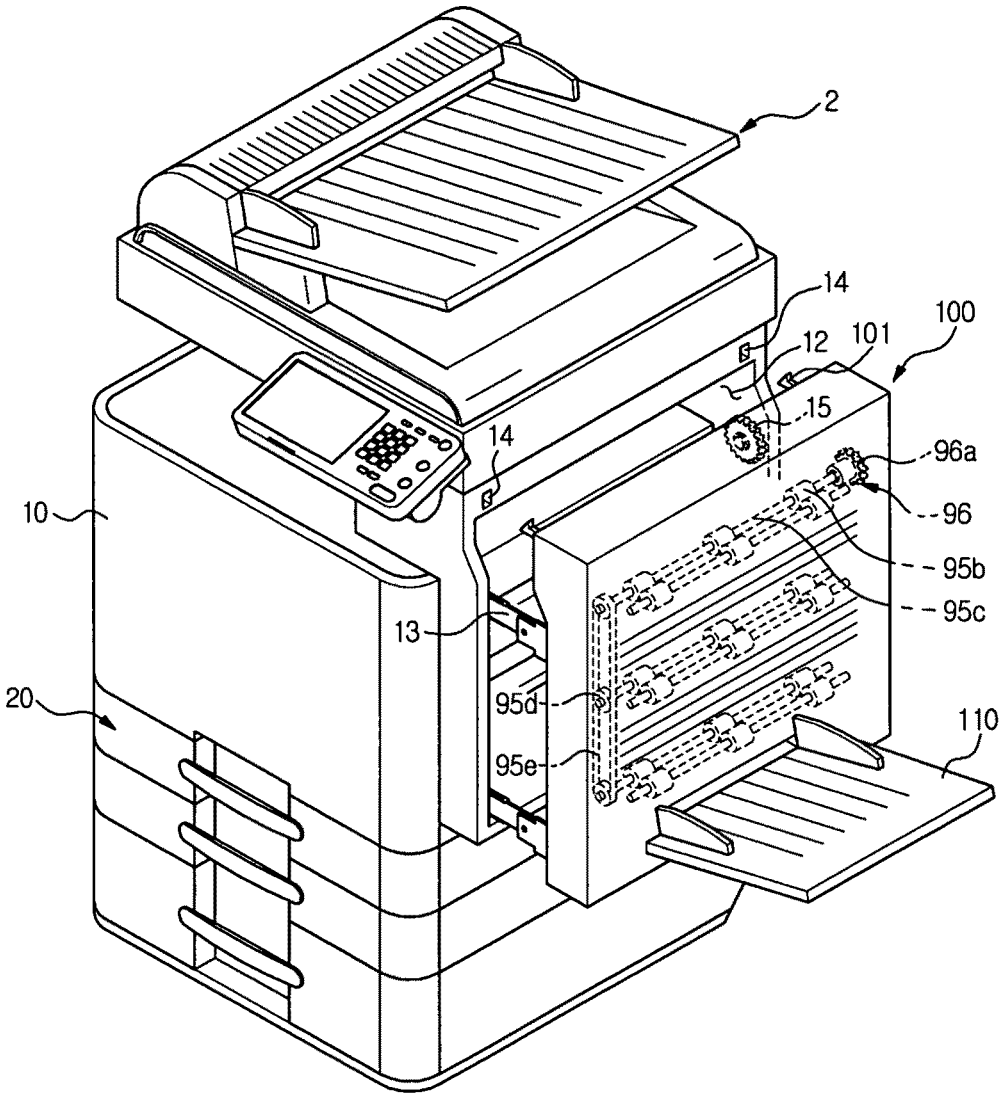
FIG. 1 is a perspective view illustrating an external appearance of an image forming apparatus in accordance with an embodiment.

Reference will now be made in detail to the embodiments, examples of which are illustrated in the accompanying drawings, wherein like reference numerals refer to like elements throughout.

Figure 2:
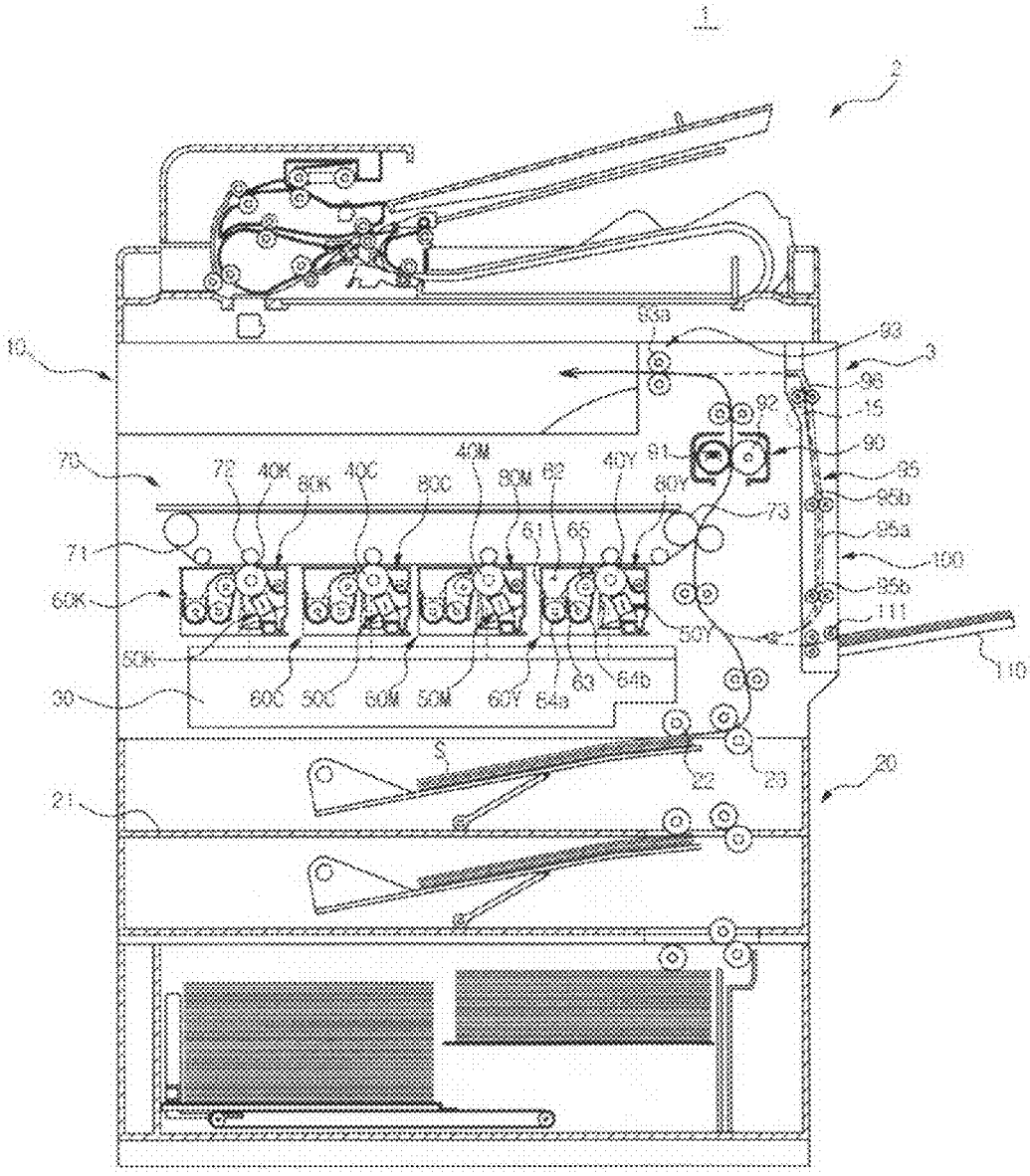
FIG. 2 is a longitudinal-sectional view schematically illustrating an internal structure of the image forming apparatus in accordance with the embodiment.

FIG. 1 is a perspective view illustrating an external appearance of an image forming apparatus in accordance with an embodiment, and FIG. 2 is a longitudinal-sectional view schematically illustrating an internal structure of the image forming apparatus in accordance with the embodiment.

With reference to FIGS. 1 and 2, an image forming apparatus 1 in accordance with the embodiment includes an image reading unit 2 to read an image recorded on a document, and a printing device 3 to print the image on papers.

The printing device 3 prints the image according to a signal input from the image reading unit 2 or a signal input from an external apparatus, such as a PC. The printing device 3 includes a main body 10, paper feeding units 20, a light scanning unit 30, photoconductors 40K, 40C, 40M, and 40Y, charging devices 50K, 50C, 50M, and 50Y, a developer supply units 60K, 60C, 60M, and 60Y, a transfer unit 70, developer recovery units 80K, 80C, 80M, and 80Y, a fixing unit 90, an exit unit 93, and a duplex printing unit 95.

The main body 10 forms an external appearance of the image forming apparatus 1, and supports various parts installed therein.

Each of the paper feeding units 20 includes a cassette 21 to store printing media S, a pick-up roller 22 to pick up the printing media S stored in the cassette 21 sheet by sheet, and feeding rollers 23 to feed the picked-up printing media S to the transfer unit 70.

The light scanning unit 30 irradiates light corresponding to image data onto the photoconductors 40K, 40C, 40M, and 40Y, and thereby forms latent electrostatic images on the surfaces of the photoconductors 40K, 40C, 40M, and 40Y.

The photoconductors 40K, 40C, 40M, and 40Y are charged with a designated electric potential by the charging devices 50K, 50C, 50M, and 50Y prior to the irradiation of light from the light scanning unit 30 onto the photoconductors 40K, 40C, 40M, and 40Y, and latent electrostatic images are respectively formed on the surfaces of the photoconductors 40K, 40C, 40M, and 40Y by light irradiated from the light scanning unit 30.

The charging devices 50K, 50C, 50M, and 50Y are scorotron-type charging devices using corona discharge. Otherwise, charging devices 50K, 50C, 50M, and 50Y may be roller-type charging devices.

The developer supply units 60K, 60C, 60M, and 60Y supplies developers onto the latent electrostatic images formed on the photoconductors 40K, 40C, 40M, and 40Y, thereby forming visible images.

The developer supply units 60K, 60C, 60M, and 60Y respectively contain developers having different colors, for example, black, cyan, magenta, and yellow developers.

The developer supply unit 60Y includes a case 61 provided with a developer receiving chamber 62 and an agitating chamber 63 formed therein, feeding members 64*a* and 64*b* received in the agitating chamber 63, and a developing roller 65 to supply the developer in the agitating chamber 63 to the photoconductor 40Y.

For reference, although this embodiment describes the developer supply unit 60Y to supply the yellow developer, the description may be applied to the developer supply units 60K, 60C, and 60M to respectively supply the black, cyan, and magenta developers.

The transfer unit 70 includes an intermediate transfer belt 71, first transfer rollers 72, and a second transfer roller 73.

The visible images formed on the surfaces of the photoconductors 40K, 40C, 40M, and 40Y are transferred onto the intermediate transfer belt 71 by the first transfer rollers 72, and the images on the intermediate transfer belt 71 are transferred to a paper, which is supplied from the paper feeding unit 20 and pass through a space between the second transfer roller 73 and the intermediate transfer belt 71.

The developer recovery units 80K, 80C, 80M, and 80Y recover the developer wastes, which are not transferred onto the intermediate transfer belt 71 but remain on the surfaces of the photoconductors 40K, 40C, 40M, and 40Y.

The fixing unit 90 includes a heating member 91 and a pressing roller 92. The heating member 91 may be provided in a roller type provided with a heating source installed therein, or in a belt type heated by a heating source.

The paper, onto which the images are transferred, passes through a space between the heating member 91 and the pressing roller 92. At this time, the images are fixed to the paper by heat and pressure.

The paper passed through the fixing unit 90 is guided to the exit unit 93, and is discharged to the outside of the main body 10 of the printing device 3 by exit rollers 93*a*.

The duplex printing unit 95 sends the printing medium S, provided with one surface on which image formation has been completed, back to the space between the second transfer roller 73 and the intermediate transfer belt 71 so as to print the images on both surfaces of the printing medium S.

Such a duplex printing unit 95 includes a duplex printing guide 95*a* forming a return path of the printing media S, and return rollers 95*b* installed on the return path to feed the printing media S.

During the duplex printing, the printing media S, provided with one surface on which image formation has been completed, exited by the exit rollers 93*a* are guided to the duplex printing guide 95*a* at a designated point of time, and are conveyed by the return rollers 95*b* so as to pass through the space between the second transfer roller 73 and the intermediate transfer belt 71. Thereby, images are formed on the other surface of the printing media S while passing through the space between the second transfer roller 73 and the intermediate transfer belt 71.

On the other hand, with reference to FIG. 1, an opening 12 to provide a specific service or remove a paper jam is provided at one side of the main body 10, and a cover member 100 to open and close the opening 12 is detachably attached to the main body 10.

If the cover member 100 opens the opening 12, a circulation path of the printing media S in the main body 10 is openable, and thus provision of the specific service of the printing device 3 and removal of the paper jam in the circulation path may be easily achieved.

The cover member 100 is connected to guide rails 13 at both sides of the opening 12, and is put into and taken out of in a sliding manner.

Further, if the cover member 100 closes the opening 12, hook parts 101 are locked with hook holes 14 provided on the main body 10, and thus the cover member 100 is fixed to the main body 10.

The duplex printing unit 95 including the duplex printing guide 95*a* (with reference to FIG. 2) and the return rollers 95*b* are mounted on the cover member 100 such that the circulation path of the printing media S is opened when the cover member 100 is taken out of the main body 10.

A manual paper feeding tray 110 is provided at one side of the cover member 100, and printing media loaded on the manual paper feeding tray 110 are picked up by a manual paper feeding pick-up roller 111 (with reference to FIG. 2) and are supplied to a printing path.

The return rollers 95*b* include pairs of roller members in rolling-contact with each other, which are provided on plural shafts 95*c*, and the pairs of roller members vertically separated from each other are configured such that power is transmitted to the pairs of roller members by pulleys 95*d* and a belt 95*e*.

The return rollers 95*b* and the manual paper feeding pick-up roller 111 perform their functions by means of power output from a driving motor (not shown) provided in the main body 10.

For this purpose, a driving gear 15 to receive rotary force of the driving motor (not shown) is provided on the main body 10, and an electronic clutch 96 having a gear part 96*a* engaged with the driving gear 15 is provided on the cover member 100.

Hereinafter, a power transmission structure to transmit power from the main body 10 to the return roller 95*a* of the duplex printing unit 95 will be described. Here, such a power transmission structure may be applied to the manual paper feeding pick-up roller 11.

The electronic clutch 96 is installed coaxially with the shaft 95*c* of the return rollers 95*b*. If the cover member 100 is mounted on the main body 10, the return rollers 95*b* receive power transmitted from the driving motor (not shown) of the main body 10 by engaging the gear part 96*a* of the electronic clutch 96 with the driving gear 15 provided on the main body 10.

The gear part 96*a* of the electronic clutch 96 is rotated together with an inner shaft (not shown) thereof connected to the shaft 95*c* of the return rollers 95*b*, when an electrical signal is applied to the electronic clutch 96, and is rotated idly when no electrical signal is applied to the electronic clutch 96.

Figure 3:
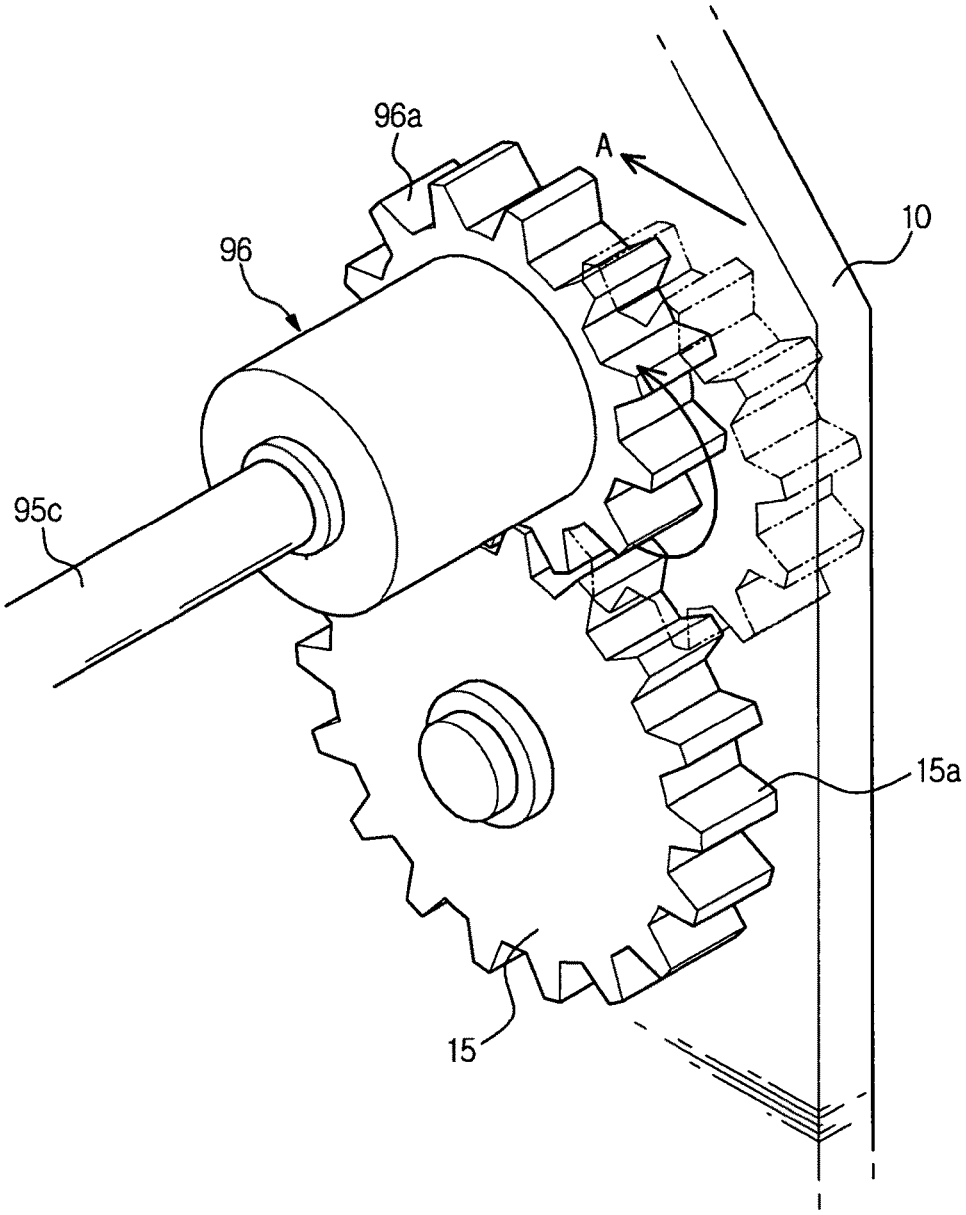
FIG. 3 is a view illustrating a power transmission structure between a main body and a cover member of the image forming apparatus in accordance with the embodiment.

Thereby, if the cover member 100 is put into and taken out of the main body 10 under the condition that the electronic clutch 96 is switched off, the gear part 96*a* of the electronic clutch 96 is rotated idly in engagement with teeth 15*a* of the driving gear 15, as shown in FIG. 3, thus being smoothly engaged with the driving gear 15.

Thereafter, when the electronic clutch 96 is switched on so as to perform duplex printing, the gear part 96 of the electronic clutch 96 being coaxial with the shaft 95*c* of the return rollers 95*b* receives rotary force of the driving gear 15 and thus rotates the shaft 95*c*, thereby driving the return rollers 95*b*.

Although FIG. 1 illustrates that the electronic clutch 96 and the return rollers 95*b* are coaxial with each other, the electronic clutch 96 and the return rollers 95*b* may be configured such that the gear part 96*a* of the electronic clutch 96 and the return rollers 95*b* are interlocked with each other, i.e. the rotary force of the electronic clutch 96 is transmitted to the return rollers 95*b* using a power transmission element, such as a belt or a gear, as an intermediate.

Thereby, power transmission from the driving gear 15 provided on the main body 10 to the return rollers 95*b* of the cover member 100 may be achieved by the electronic clutch 96, and thus the structure to transmit power from the main body 10 to the cover member 100 may be simplified, thereby reducing the number of parts and material costs.

Further, in case of a power transmission structure from the main body 10 to the cover member 100 using a swing gear supported by elastic force to transmit power, when a large load is input, noise and damage to the gear may be caused. On the other hand, the power transmission structure using the electronic clutch 96 in accordance with this embodiment prevents noise and damage to the gear, thereby improving reliability.

Figure 4:
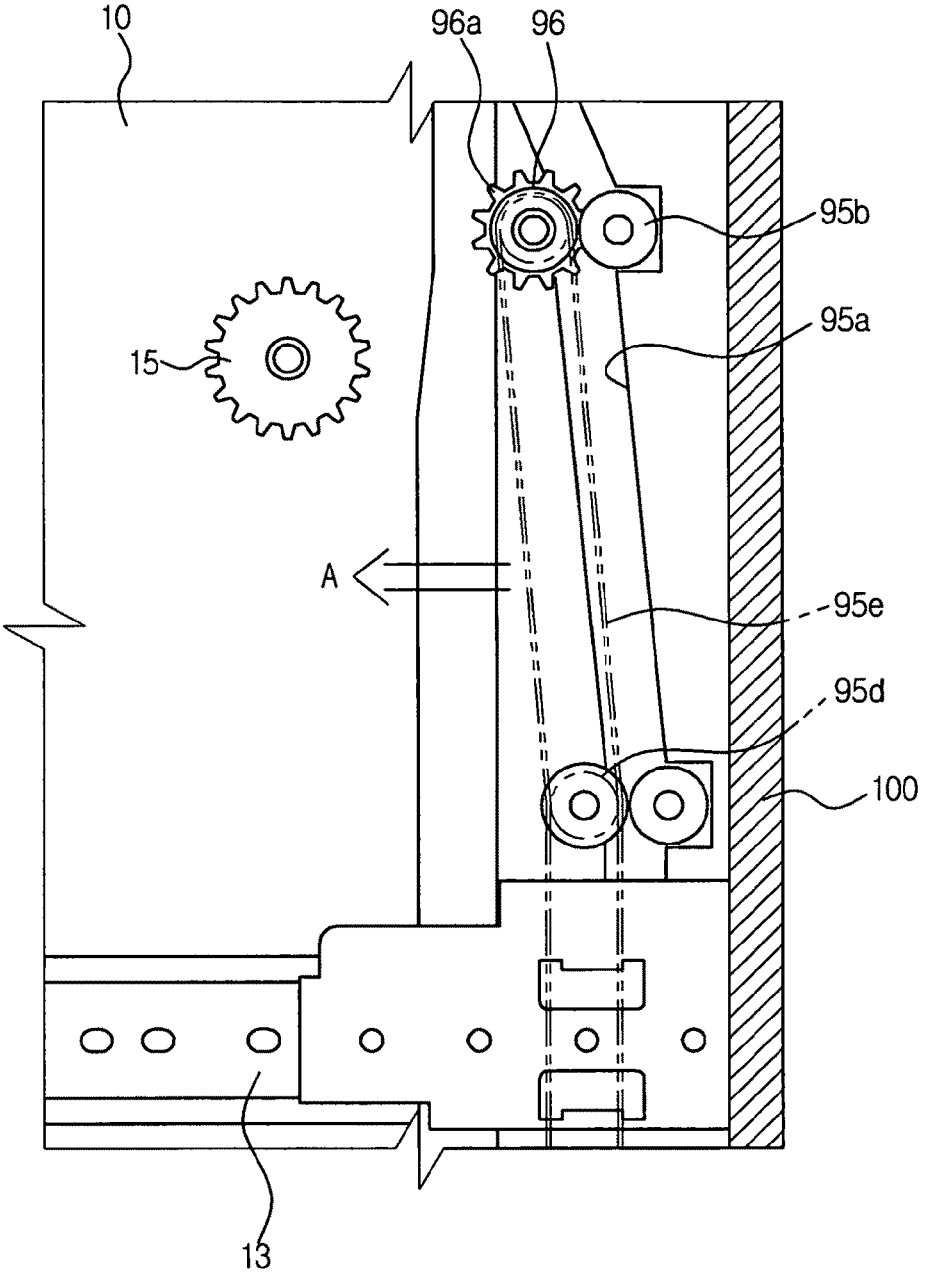
FIG. 4 is a longitudinal-sectional view illustrating a mounting state of the cover member on the main body of the image forming apparatus in accordance with the embodiment.

Moreover, if the cover member 100 is mounted on the main body 10 in the sliding manner, as shown in FIG. 4, the gear part 96*a* of the electronic clutch 96 may be arranged at a position which is stably engaged with the driving gear 15.

Figure 5:
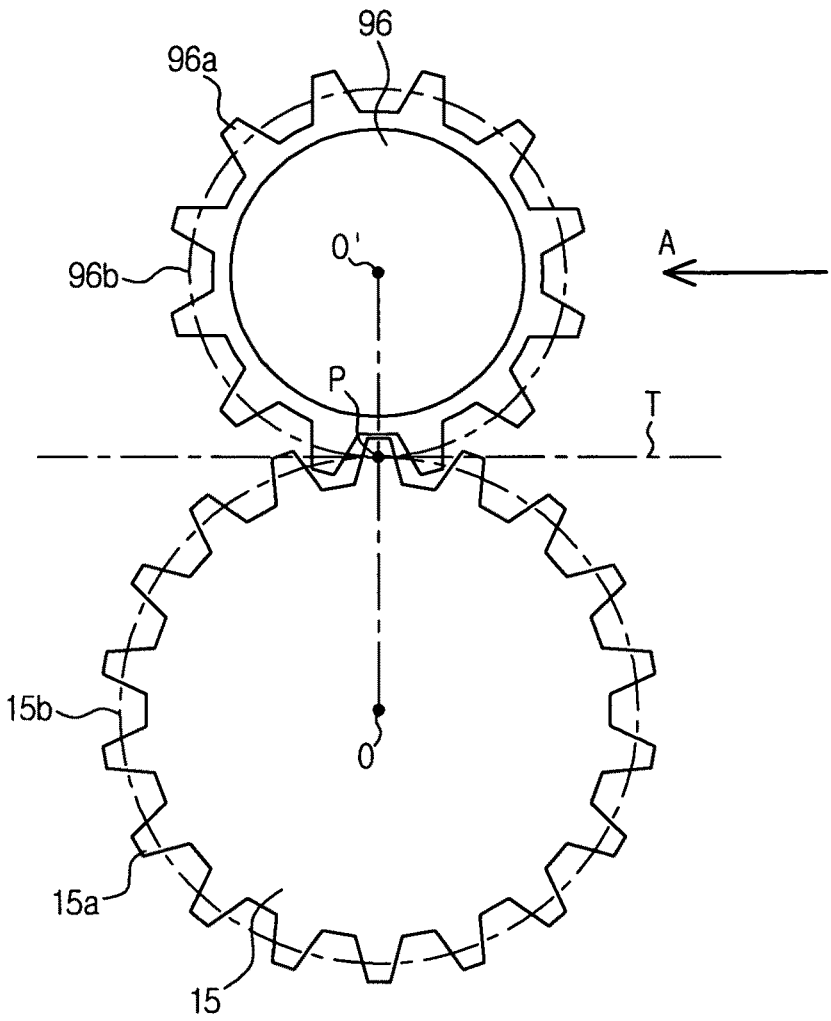
FIG. 5 is a longitudinal-sectional view illustrating an engaged state between a driving gear and a gear part of an electronic clutch, when the cover member is mounted on the main body of the image forming apparatus in accordance with the embodiment.

That is, if the cover member 100 is mounted on the main body 10, as shown in FIG. 5, a line obtained by connecting the center O' of the gear part 96*a* and the center O of the driving gear 15 may be perpendicular to a progress direction A of the cover member 100.

Further, if the gear part 96*a* of the electronic clutch 96 is engaged with the driving gear 15, a direction of a common tangent line T passing through a pitch point formed at a contact point between a pitch circle 15*b* of the driving gear 15 and a pitch circle 96*b* of the gear part 96*a* may be equal to the progress direction A of the cover member 100.

Therefore, a gear engagement error generated due to a position deviation E, when the cover member 100 is mounted on the main body 10, may be maximally offset.

Table 1 states design variations of the driving gear 15 and the gear part 96*a* of the electronic clutch 96 in accordance with the embodiment of the present invention, and Table 2 states contact ratios and toothed surface strengths of the driving gear 15 and the gear part 96*a* according to mounting errors of the cover member 100 when the cover member 100 is mounted on the main body 10.

Figure 6:
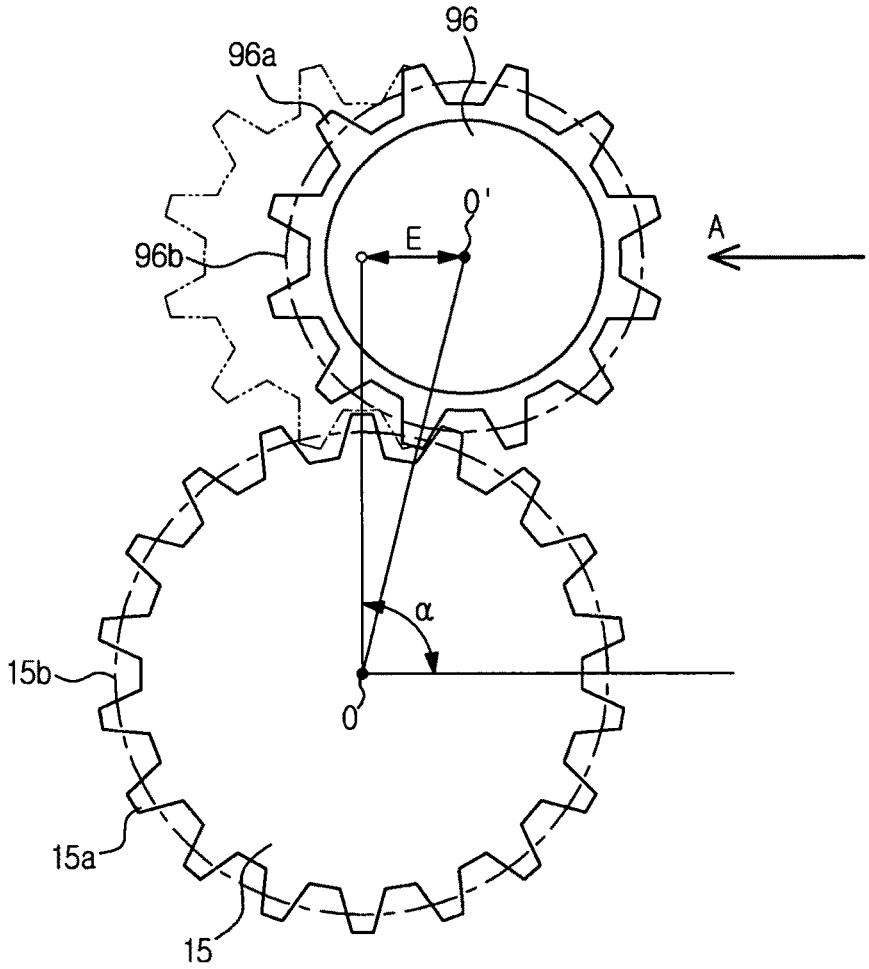
FIG. 6 is a longitudinal-sectional view illustrating an engaged state between the driving gear and the gear unit of the electronic clutch while having a position deviation, when the cover member is mounted on the main body of the image forming apparatus in accordance with the embodiment.

Table 2 states contact ratios at position deviations E of 0~5 mm, if the driving gear 15 and the gear part 96*a* are engaged with each other such that an angle $\alpha$ formed by the line OO', obtained by connecting the center O' of the gear part 96*a* and the center O of the driving gear 15, and a horizontal line passing through the center C of the driving gear 15 is in the range of 80~90 degrees, as shown in FIG. 6.

That is, when the cover member 100 is mounted on the main body 10, the driving gear 15 provided on the main body 10 and the gear part 96*a* of the electronic clutch 96 provided on the cover member 100 are not engaged with each other at a set position (a virtual line) due to a mounting error of the cover member 100 on the main body, but are engaged with each other with a position deviation E, i.e., at a position separated from the set position by a designated distance.

In this case, the position at which the driving gear 15 and the gear part 96*a* of this embodiment are engaged with each other may be a position at which the line, obtained by connecting the center O' of the gear part 96*a* and the center O of the driving gear 15, is perpendicular to the progress direction A of the cover member 100. Therefore, although the driving gear 15 and the gear part 96*a* are engaged with each other with the designated position deviation E from the set position, the number of teeth of the driving gear 15 and the gear part 96*a*, which are simultaneously engaged with each other (when the engagement starts and when the engagement ends), i.e., a contact ratio is more than 1, even if the gear part 96*a* is separated from the set position by a designated distance (0~5 mm), and thus the driving gear 15 and the gear part 96*a* may be smoothly engaged with each other without a thud.

Thereby, an error in power transmission from the main body 10 to the cover member 100 may be reduced, and thus safety is further improved.

It is apparent than the above position deviation E may be varied by properly selecting the design variations of the driving gear 15 and the gear part 96*a* of the electronic clutch 96.

TABLE 1

| Segment | Driving gear | Gear part |
|---|---|---|
| Module | 1.0 | |
| Pressure angle at normal section | 2.0 | |
| Helix angle at reference circle | 0 | |
| Number of teeth | 31 | 24 |
| Profile shift coefficient | 0 | 0 |
| Operating center distance | 27.66 | |
| Reference Diameter(mm) | 31 | 24 |
| Gear Type | Spur | |
| RPM | 308.35 | 398.28 |
| Torque | 0.1041 Nm | 0.0806 Nm |
| Span number of teeth | 4 | 3 |
| Normal Base Tangent Length (mm) | 10.767 | 7.716 |
| Face width (mm) | 11.0 | 6.0 |
| Axial Offset (mm) | 3.5 | |
| Material | Delin 500P(POM) | NW-02(POM) |

TABLE 2

| α | Cover member mounting error | Contact ratio | Toothed surface strength |
|---|---|---|---|
| 90° | 0 mm | 1.3839 | 1.7377 |
| 88° | 1 mm | 1.3763 | 1.7370 |
| 86° | 2 mm | 1.3298 | 1.7347 |
| 84° | 3 mm | 1.2511 | 1.7312 |
| 82° | 4 mm | 1.1421 | 1.7269 |
| 80° | 5 mm | 1.0056 | 1.7224 |

Further, if power transmission from the main body 10 to the cover member 100 is achieved through the driving gear 15 and the gear part 96*a* of the electronic clutch 96, a designer freely adjusts a distance between the centers of the driving gear 15 and the gear part 96*a* and thus designs strengths of the driving gear 15 and the gear part 96*a* according to stresses applied to a contact surface between the driving gear 15 and the gear part 96*a*, thereby being capable of easily determining bending strengths of the driving gear 15 and the gear part 96*a* and life spans of the driving gear 15 and the gear part 96*a* relative to abrasion.

As is apparent from the above description, an image forming apparatus in accordance with one embodiment simplifies power transmission from a main body to a cover member attached to and detached from the main body in a sliding manner, thereby reducing the number of parts and material costs, and thus improving productivity.

Further, a power transmission structure of the image forming apparatus in accordance with the embodiment reduces noise generation and power transmission loss, thereby improving reliability.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. An image forming apparatus comprising: a main body including an opening and a driving gear adjacent to the opening; and a cover member slidably provided on the main body so as to open the opening when in an open position and to close the opening when in a closed position, the cover member including roller members and an electronic clutch, wherein the roller members are driven by power transmitted from the driving gear, the electronic clutch is configured to transmit driving force to the roller members, the electronic clutch having a gear part engaged with the driving gear when the cover member is in the closed position and the gear part being detached from the driving gear when the cover member is in the open position, the gear part is configured to rotate together with the roller members when an electrical signal is applied to the electronic clutch, the gear part is configured to rotate idly when no electrical signal is applied to the electronic clutch, and the gear part of the electronic clutch is coaxial with at least one of the roller members, and when the gear part and the driving gear are engaged with each other, a line obtained by connecting a center of the gear part and a center of the driving gear is perpendicular to a horizontal progress direction of the cover member.

2. The image forming apparatus according to claim 1, wherein, when the gear part and the driving gear are engaged with each other, a direction of a tangent line passing a pitch point between the gear part and the driving gear coincides with a horizontal progress direction of the cover member.

3. The image forming apparatus according to claim 1, wherein the gear part approaches the main body in a direction in which a line obtained by connecting a center of the gear part and a center of the driving gear is perpendicular to a horizontal progress direction of the cover member.

4. The image forming apparatus according to claim 1, wherein the roller members include return rollers of a duplex printing unit.

5. The image forming apparatus according to claim 1, wherein the roller members include a manual paper feeding pick-up roller to pick up printing media loaded on a manual paper feeding tray.

6. The image forming apparatus according to claim 1, further comprising guide rails to guide sliding of the cover member into and out of the main body.

7. The image forming apparatus according to claim 6, wherein hook parts connected to the main body are provided on the cover member.

8. The image forming apparatus according to claim 1, wherein the electronic clutch is coaxial with the roller members.

* * * * *